United States Patent [19]

Szadkowski

[11] 4,220,271

[45] Sep. 2, 1980

[54] DEVICE FOR REPLACING POURING TUBES

[75] Inventor: Stanislav Szadkowski, Brussels, Belgium

[73] Assignee: Vesuvius International Corporation, Wilmington, Del.

[21] Appl. No.: 29,403

[22] Filed: Apr. 12, 1979

[30] Foreign Application Priority Data

Apr. 24, 1978 [GB] United Kingdom ..... 16121/78

[51] Int. Cl.[3] ..... B67D 3/02; C21C 5/46

[52] U.S. Cl. ..... 222/607; 266/236

[58] Field of Search ..... 266/236; 222/606, 607, 222/591; 164/337, 437, 438

[56] References Cited

U.S. PATENT DOCUMENTS

| | | | |
|---|---|---|---|
| 3,727,805 | 4/1973 | Shapland | 222/606 X |
| 3,907,022 | 9/1975 | Simons et al. | 222/606 X |
| 4,079,869 | 3/1978 | Meier et al. | 164/337 X |
| 4,091,861 | 5/1978 | Thalmann et al. | 222/606 X |

*Primary Examiner*—John H. Mack
*Assistant Examiner*—D. R. Valentine
*Attorney, Agent, or Firm*—Sughrue, Rothwell, Mion, Zinn and Macpeak

[57] ABSTRACT

A device for replacing pouring tubes at the outlet of a pour vessel for molten metal in which interconnected frames supporting the pouring tubes in a free swiveling manner are guided according to a linear path along the vessel outlet by suitable guiding means, whereby the pouring tube nearing the outlet is brought in close contact with an outlet plate by suitable steering and pushing means.

10 Claims, 3 Drawing Figures

DEVICE FOR REPLACING POURING TUBES

BACKGROUND OF THE INVENTION

This invention relates to a device for replacing pouring tubes at the outlet of a vessel containing molten metal, herein further referred to as a "pour vessel".

More particularly the invention relates to such a device by means of which a refractory pouring tube may be removed from the vessel outlet and at the same time replaced by another refractory pouring tube, whereby such replacing may be performed in a minimum of time and with a minimum of risks.

PRIOR ART

Devices for replacing pouring tubes at the outlet of a pour vessel, whereby a refractory pouring tube is prepared in a waiting position while another pouring tube is maintained in its working position, and whereby said prepared pouring tube is brought into working position while the other pouring tube is removed therefrom, are already known.

Such known devices may, for instance, consist of a revolving supporting beam for the pouring tubes, whereby there may be provided one pouring tube at each extremity of the revolving supporting beam; while there is maintained one pouring tube in front of the vessel outlet, at the one extremity of said revolving supporting beam, another pouring tube may be prepared at the other extremity of the revolving beam. For replacing the pouring tube at the outlet of the vessel shell the revolving beam is then turned around in a plane perpendicular to the axis of the vessel outlet, so the the prepared pouring tube is brought in front of the vessel outlet.

Owing to the circular outreach of the hot pouring tube coming from the position in front of the vessel outlet and turning to the rest position, there are however definite hazards for the operator of such revolving beam device.

Such known devices further often give rise to problems with respect to the tightness of the contact between the upper surface of the pouring tube and the refractory outlet plates on the pouring vessel.

It is indeed very difficult to adequately provide urging means in such devices for tightly applying the pouring tubes against the vessel outlets.

SUMMARY OF THE INVENTION

It is an object of the present invention to provide a pouring tube replacement device for use on a pour vessel for molten metal, which avoids the above drawbacks of the known mechanisms and allows a safe and quick replacing of a pouring tube at the outlet of a pour vessel and a close and tight contact between said pouring tube and the vessel outlet or vessel outlet refractory plates.

Said new device comprises interconnected frames supporting the pouring tubes in a free swiveling manner, said supporting frames and pouring tubes being guided according to a linear path along the vessel outlet by suitable guiding means whereby the pouring tube nearing the outlet is brought in close contact with an outlet plate by suitable steering and pushing means.

The device according to the invention, for replacing pouring tubes at the outlet of a pour vessel for molten metal comprises:

at least two mutually interconnected movable supporting frames for pouring tubes, each adapted to receive and support one refractory pouring tube in such a manner that said refractory pouring tube is able to swivel around two perpendicular rotation axes extending perpendicularly to the axis of the vessel outlet, guiding means for leading said interconnected movable supporting frames in front of the vessel outlet according to a linear path, substantially perpendicular to the axis of the vessel outlet, and steering and pushing means, acting on said supporting frames to bring the upper surface of the pouring tube in close contact with a refractory plate located at the vessel outlet and to urge said pouring tube tightly against said refractory plate, when the supporting frames are in the vicinity of the vessel outlet.

According to a specific feature of the invention said supporting frames for pouring tubes may in particular be connected to a common carrier guided along a linear path extending perpendicular to the axis of the vessel outlet.

According to another specific feature of the invention each supporting frame may be hinged in such a manner that it is able to swivel freely according to a plane parallel to the axis of the vessel outlet, whereby said steering means are adapted to swivel the supporting frame upwards towards the vessel outlet when it is in a position near the vessel outlet and to swivel it back downwards when it leaves the position near the vessel outlet.

In one embodiment of this device according to the invention, each supporting frame comprises a lever arm, steered by a guiding element, and thus adapted to swivel said freely hinged supporting frame up- and downwards, whereby said pushing means for urging the pouring tube against said refractory plate act on the extreminty of said lever arm, when said supporting frame is located in front of the vessel outlet.

In one further embodiment of the device according to the invention each pouring tube is supported by a tube holder adapted to be placed in a supporting frame.

In these latter two embodiments each lever arm may move specifically extend perpendicularly to the axis of the linear movement of the supporting frames and substantially perpendicularly to the axis of the vessel outlet, whereby said supporting frame is hinged in a free swiveling manner around the axis of said lever arm, the tube holder being hinged in said supporting frame in a free swiveling manner around an axis perpendicular to the axis of said lever arm and perpendicular to the axis of the vessel outlet, thereby performing the free swiveling movement of the pouring tube around two perpendicular rotation axes extending perpendicularly to the axis of the vessel outlet.

According to further features of the embodiments of this invention comprising supporting frames connected to a common carrier and steered lever arms on said supporting frames, said lever arms are fixed perpendicularly to transverse rods of the supporting frames, said rods being provided to said supporting frames at their side remote from the vessel outlet, whereby one of the extremities of each of said lever arms is hinged in a free swiveling manner in a bearing element, which is itself hinged to said common carrier of the supporting frames in a free swiveling manner around a rotation axis parallel to the linear movement of the supporting frames, whereas the other extremities of said lever arms are provided with rollers or wheels guided in longitudinal guiding slots.

According to another further feature of the invention the pushing means for urging said pouring tube tightly against said refractory plate are selected among springs, jacks, counterweights, dash-pots and the like.

In a very specific embodiment of the device according to the invention the supporting frames for pouring tubes are connected to a common carriage bearing on rollers or wheels provided to each side of said carriage, said rollers or wheels being guided in two linear guiding tracks extending perpendicularly to the vessel outlet.

According to another feature of the invention the supporting frames for pouring tubes and the refractory pouring tubes or the tube holders may be provided with cooperating means allowing to introduce the refractory pouring tubes or the tube holders into said supporting frames or to remove them therefrom in a movement substantially parallel to the plane of the supporting frame.

More specifically such cooperating means may consist of longitudinal slots or beams provided in or to the inner lateral sides of the supporting frames and of pins or edges provided to the refractory pouring tubes or tube holders to fit in or on said slots or beams.

The device according to the invention may further be adapted directly to the outer shell of a pour vessel or be provided with means for arranging and/or fixing it to the outer shell of a pour vessel.

DETAILED DESCRIPTION OF THE PREFERRED EMBODIMENT

Figure 1:
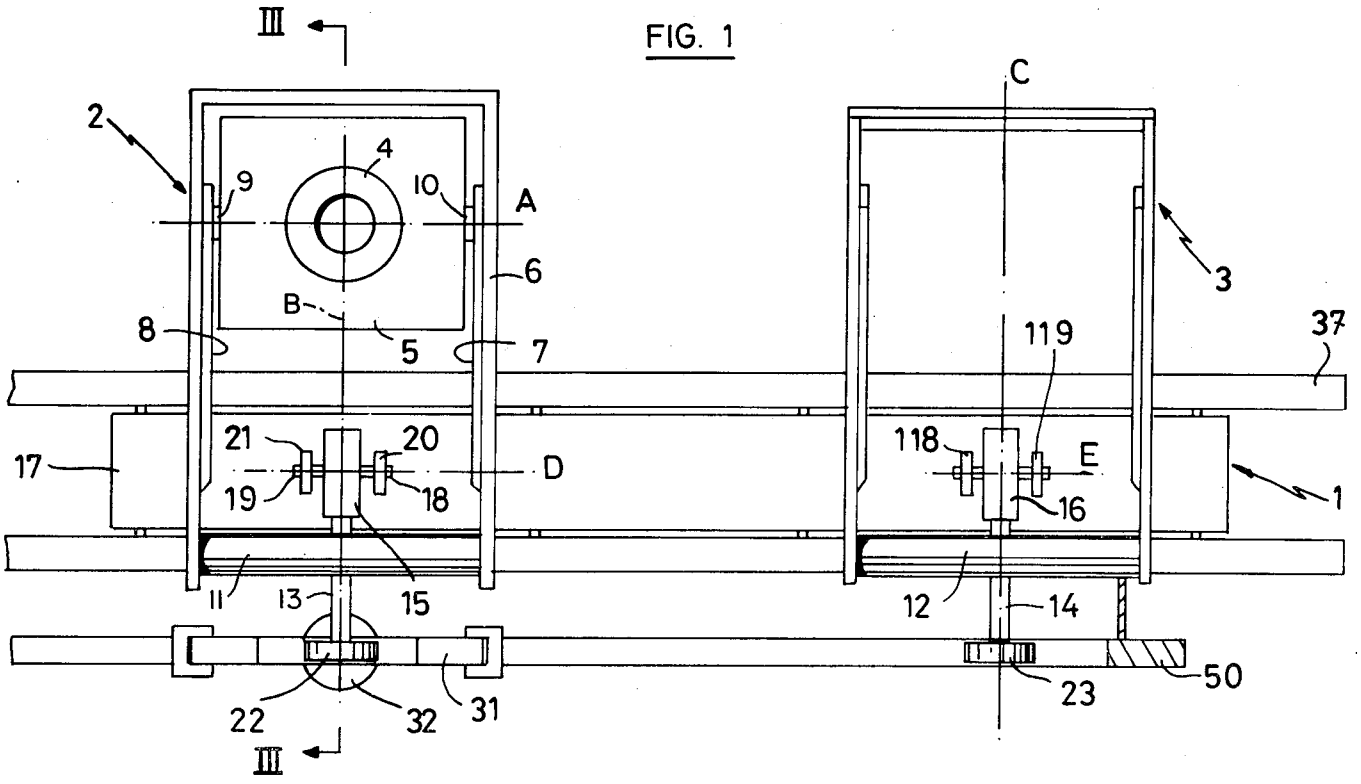
FIG. 1 is a bottom plan view, with partially removed parts, of one embodiment of a device for replacing pouring tubes according to the invention.
Figure 2:
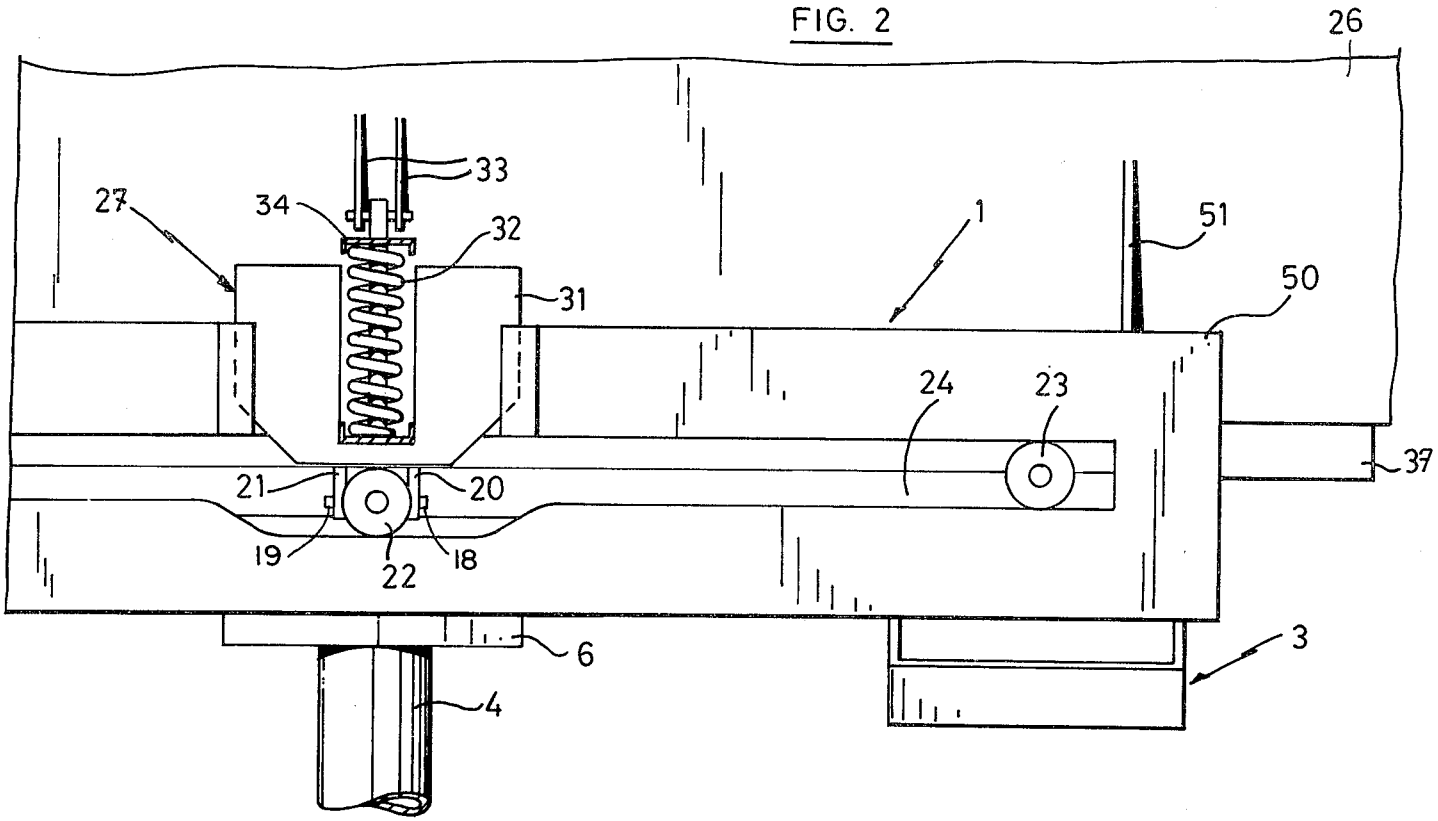
FIG. 2 is a side view of the device according to FIG. 1.
Figure 3:
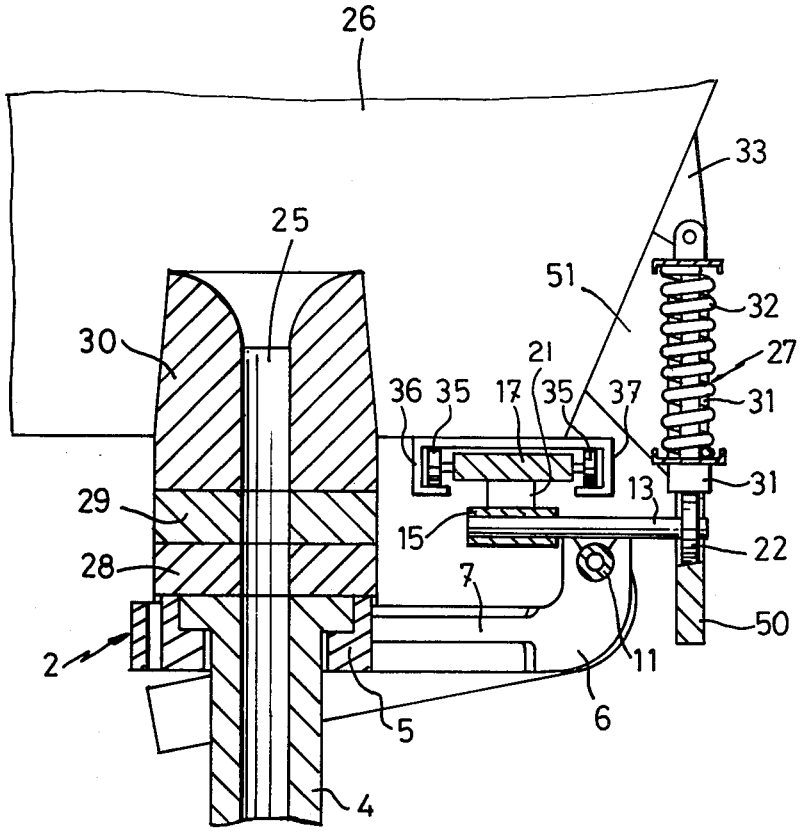
FIG. 3 is a partial section through to the plane III—III of FIG. 1.

The device for replacing pouring tubes shown in FIGS. 1 to 3, designated as a whole by the reference character 1, comprises two supporting frames 2, 3 for refractory tubes 4 placed in tube holders 5.

Each supporting frame 2, 3 consists of a U-shaped supporting fork 6, provided with longitudinal rails 7, 8 on both of its inner lateral sides, adapted to hold lateral pins 9, 10 provided on the sides of the tube holder 5.

As shown more in particularly in FIG. 3, the U-shaped supporting forks 6 are bent upwards at their open extremities and provided there with a transverse rod 11 (12), so that the tube holders 5, containing a refractory tube 4, may be introduced in and removed from the supporting frames 2, 3 in an unhindered movement in the plane of the supporting frames 2, 3.

Each tube holder 5 is able to swivel freely around a rotation axis A passing through the centers of the pins 9, 10 provided on the sides of the tube holder 5.

The supporting frames 2, 3 are as a whole fixed to lever arms 13, 14 welded to the transverse rods 11, 12.

These lever arms 13, 14 are journaled at one of their extremities in bearing elements 15, 16, in such a manner that the lever arms 13, 14 are able to rotate around their axes B, C, thus also allowing the swiveling of the supporting frames 2, 3 around the rotation axes B, C.

The bearing elements 15, 16 are themselves hinged to a common carrier 17 of both supporting frames 2, 3, by means of pivots 18, 19 swiveling in suitable bores provided in pivot ears 20, 21, fixed to the common carrier 17.

The lever arms 13, 14 are thus able to swivel also around rotation axes D, E, passing through the centers of the pivots 18, 19 (118, 119), which means that also the supporting frames 2, 3 are able to swivel as a whole around the rotation axes D, E.

In this manner each supporting frames 2, 3 is able to swivel around two perpendicular axes B, D and C, E, respectively, and the tube holders and refractory tubes contained therein are able to swivel around rotation axes A parallel to the rotation axes D, E.

The other extremities of lever arms 13, 14 are provided with rollers 22, 23, guided in a longitudinal guiding slot 24, provided in a plate or beam 50 connected to the outer shell of the pour vessel 26 through supports 51 attached to the pour vessel.

The shape of this longitudinal slot is so adapted to swivel the lever arms 13, 14, and the supporting frames 2, 3 attached thereto, upwards when the supporting frames 2, 3 are approaching the position near the outlet 25 of the pour vessel 26 and downwards when the supporting frames 2, 3 leave the position near the vessel outlet 25, by steering the roller wheels 22, 23 attached to the lever arms 13, 14, according to a path having suitable level changes, as best shown in FIG. 2.

When reaching the position in front of the vessel outlet 25, the supporting frames 2, 3 are further subjected to the urging force of a pusher device 27 acting on the roller wheels 22, 23 of the lever arms 13, 14.

The refractory tube 4 and tube holder 5, supported by the supporting frames 2, 3 are thus pushed upwards in tight and close cooperating contact with a refractory bottom plate 28 at the outlet 25 of the pour vessel 26, comprising further a refractory upper plate 29 and a refractory inner nozzle 30.

The pusher device 27 consists of a pushing and guiding element 31 and a coil spring 32 connected to the outer surface of the pour vessel 26 by means of supports 33 fixed thereto.

The coil spring 32 thereby bears at its upper extremity against the upper spring flange 34 and pushes at its lower extremity against the guiding element 31.

The common carrier 17 of the two supporting frames 2, 3 of the devices according to the invention represented in the attached FIGS. 1 to 3, is provided at each side with four wheels 35, guided by means of two rails 36, 37 fixed to the outer shell of the pour vessel 26.

The carrier 17 bearing the supporting frames 2, 3 may thus be moved along a linear path in the vicinity of the outlet 25 of the pour vessel, whereby the supporting frames 2, 3 may be moved in front of the vessel outlet 25, so as to bring a pouring tube 4 in its working position in close and tight cooperating contact with the refractory bottom plate 28 at the vessel outlet.

Owing to the swiveling freeness of the pouring tubes 4 around the axis A and the swiveling freenesses of the supporting frames 2, 3 around their respective axes B, D and C, E, the pouring tubes 4 are able to adapt their upper surface in a self adjusting manner to the lower surface of the refractory bottom plate 28.

One advantage of the invention is that the entire operation of the device is performed along an axis, which may for instance very conveniently correspond to the axis of the pouring ingot.

Another advantage is that the operator of the device is able to perform all required handlings from his usual working position; more particularly it is possible with the device according to the invention to load the supporting forks with a refractory tube from the usual position of the operator (i.e. the back side of the device).

It is also a further advantage of these devices according to the invention that it is possible to have access to the refractory outlet plates, between two supporting frames for pouring tubes of such device, to clean the refractory outlet plates or to carry out any other maintainance operation.

The use of a device for replacing pouring tubes according to the invention allows a tundish to be kept in operation for a much longer period than the life of a refractory pouring tube, as such pouring tube may be replaced with only a very short interruption of the pouring operation.

What I claim is:

1. Device for replacing pouring tubes at the outlet of a pour vessel for molten metal, comprising: (a) at least two mutually interconnected movable supporting frames (2,3) for refractory pouring tubes (4), each adapted to receive and support one pouring tube in such a manner that said tube is able to swivel around two perpendicular rotation axes (A; B or C) extending perpendicularly to the axis of the vessel outlet, (b) guiding means (36, 37, 24, 50) for leading said interconnected movable supporting frames in front of the vessel outlet (25) according to a linear path, substantially perpendicular to the axis of the vessel outlet, and (c) steering and pushing means (22, 27), acting on said supporting frames, to bring the upper surface of the pouring tube into close contact with a refractory plate (28) located at the vessel outlet and to urge said pouring tube tightly against said refractory plate, when the supporting frames are in the vicinity of the vessel outlet.

2. Device according to claim 1, in which said supporting frames for pouring tubes are connected to a common carrier (17) guided along a linear path extending perpendicularly to the axis of the vessel outlet.

3. Device according to claim 1, in which each supporting frame is hinged in such a manner that it is able to swivel freely about an axis (D, E) perpendicular to and spaced from the axis of the vessel outlet, said steering means being adapted to swivel and supporting frame upwards towards the vessel outlet when it is in a position near the vessel outlet and to swivel it back downwards when it leaves the position near the vessel outlet.

4. Device according to claim 3, in which each supporting frame comprises a lever arm (13, 14) steered by a guiding element (22, 23) and adapted to swivel said freely hinged supporting frame up and down, said pushing means for urging the pouring tube against said refractory plate acting on an extremity of said lever arm when said supporting frame is located in front of the vessel outlet.

5. A device according to claim 4, in which each lever arm extends perpendicularly to the axis of the linear movement of the supporting frames and substantially perpendicularly to the axis of the vessel outlet, said supporting frame being hinged in a free swiveling manner around the axis (B, C) of said lever arm, and wherein each pouring tube is supported by a tube holder (5) adapted to be placed in a supporting frame, the tube holder being hinged in said supporting frame in a free swiveling manner around an axis (A) perpendicular to the axis of said lever arm and perpendicular to the axis of the vessel outlet, thereby performing the free swiveling movement of the pouring tube around two perpendicular rotation axes extending perpendicularly to the axis of the vessel outlet.

6. Device according to claim 4, in which the lever arms are fixed perpendicularly to transverse rods (11, 12) of the supporting frames, said rods being provided on said supporting frames at their sides, remote from the vessel outlet, one of the extremities of each of said lever arms being hinged in a free swiveling manner in a bearing element (15), which is itself hinged to a linearly guided common carrier for the supporting frames, in a free swiveling manner around a rotation axis parallel to the linear movement of the supporting frames, the other extremities of said lever arms being provided with rollers guided in a longitudinal guiding slot.

7. Device according to claim 1, in which said supporting frames for pouring tubes are connected to a common carrier bearing on rollers (35) provided on each side of said carrier, said rollers being guided in two linear guiding tracks (36, 37) extending perpendicularly to the vessel outlet.

8. Device according to claim 1, in which said supporting frames for pouring tubes and said refractory pouring tubes are provided with cooperating means (7, 8, 9, 10) allowing the refractory pouring tubes to be introduced into said supporting frames or removed therefrom in a movement substantially parallel to the plane of the supporting frame.

9. Device according to claim 8, in which said cooperating means consist of longitudinal slots provided in the inner lateral sides of the supporting frames and pins provided on tube holders of the refractory pouring tubes which fit into said slots.

10. Device according to claim 1, mounted on the outer shell of a pour vessel for molten metal.

* * * * *